US009284822B2

(12) United States Patent
Ayres

(10) Patent No.: US 9,284,822 B2
(45) Date of Patent: Mar. 15, 2016

(54) METHOD FOR CHEMICAL TREATMENT OF A SUBSURFACE WELLBORE

(71) Applicant: Robert N. Ayres, The Woodlands, TX (US)

(72) Inventor: Robert N. Ayres, The Woodlands, TX (US)

( * ) Notice: Subject to any disclaimer, the term of this patent is extended or adjusted under 35 U.S.C. 154(b) by 280 days.

(21) Appl. No.: 13/935,690

(22) Filed: Jul. 5, 2013

(65) Prior Publication Data

US 2015/0007987 A1 Jan. 8, 2015

(51) Int. Cl.

| | |
|---|---|
| ***E21B 43/12*** | (2006.01) |
| ***E21B 41/02*** | (2006.01) |
| ***E21B 37/06*** | (2006.01) |

(52) U.S. Cl.

CPC ..... *E21B 41/02* (2013.01); *E21B 37/06* (2013.01)

(58) Field of Classification Search

CPC ..... E21B 43/12

See application file for complete search history.

(56) References Cited

U.S. PATENT DOCUMENTS

| | | | | |
|---|---|---|---|---|
| 3,833,076 | A * | 9/1974 | Griffin, III | 175/38 |
| 4,394,090 | A * | 7/1983 | Hyde | 368/121 |
| 4,919,595 | A * | 4/1990 | Likuski | F04B 49/225 210/198.2 |
| 5,209,301 | A | 5/1993 | Ayres | |
| 7,721,806 | B2 | 5/2010 | Ayres | |

* cited by examiner

*Primary Examiner* — Angela M DiTrani
*Assistant Examiner* — Andrew H Sue-Ako
(74) *Attorney, Agent, or Firm* — Richard A. Fagin

(57) ABSTRACT

A method for injecting treatment chemical into a well includes selecting times at which to operate a chemical dispenser to inject a selected amount of treatment chemical into a well. At each selected time whether a wellbore pump is operating is determined. If the pump is operating the selected amount of treatment chemical is dispensed into the well. If the pump is not operating, no chemical is dispensed and a counter is incremented. At each subsequent selected time, the determining whether the well pump is operating is repeated. When a subsequent selected time coincides with a time at which the well pump is determined to be operating, the chemical dispenser is operated to inject a product of the number in the counter plus one, and the selected amount of treatment chemical into the well.

6 Claims, 2 Drawing Sheets

METHOD FOR CHEMICAL TREATMENT OF A SUBSURFACE WELLBORE

CROSS-REFERENCE TO RELATED APPLICATIONS

Not applicable

STATEMENT REGARDING FEDERALLY SPONSORED RESEARCH OR DEVELOPMENT

Not applicable.

BACKGROUND

This disclosure relates generally to the field of chemical treatment systems for use with hydrocarbon producing wells. More specifically, the disclosure relates to methods for operating chemical treatment systems which inject chemicals into the well.

In wellbores drilled through subsurface formations and then used for production of hydrocarbons, a pipe or casing may be disposed in the wellbore from the Earth's surface to the bottom of the well. The casing serves to hydraulically isolate the various subsurface formations penetrated by the wellbore and to provide the wellbore with a degree of mechanical stability. Typically a tubing string, which is a pipe of considerably lesser diameter than the casing, is positioned within the well casing. The purpose of the tubing string is to enable produced fluids to move to the Earth's surface at greater velocity than would be possible within the casing. The hydrocarbons, and in many cases a considerable amount of connate water (water naturally present in the pore spaces of the formations), enter the tubing through perforations located adjacent the producting formations, travel through the tubing, to a wellhead at the Earth's surface. In some wells, where the natural fluid pressure in the subsurface formations is not sufficient to lift the produced fluids to the Earth's surface, the fluids may be pumped to the surface with a "sucker rod" pump or with a downhole electrical submersible pump.

At the Earth's surface, various production equipment directs the produced fluids to holding tanks and/or to a pipeline. The production equipment typically comprises tubing, valves, piping, and other components. The produced fluids may contain numerous compounds which adversely affect the production equipment. For example, paraffins and water/oil emulsions can coat well production equipment and can eventually plug off the tubing and/or plug the perforations in the casing. In addition, chemical reactions between the produced fluids and metallic equipment can cause scale to be formed on the well production equipment, and some compounds in the produced fluids can corrode the well production equipment.

Various techniques are known in the art to treat these well conditions to extend the useful life of the well production equipment, tubing and casing. In wells susceptible to paraffin build-up, for example, "treater trucks" or "hot oil trucks" are regularly dispatched to pump heated oil and/or heated water into the well. The heated oil and/or water is pumped into the well through the annular space between the tubing and the casing, travels down through the annulus to melt the paraffin deposits in the well production equipment, and the returns to the surface through the tubing. In wells susceptible to corrosion and scale problems, high pressure injection treater trucks pump batches of chemicals into the well to chemically remove the scale, and to inhibit the causes of corrosion. All of these techniques require regular maintenance services which are costly and which do not continuously treat the well. Treater truck or batch treatment of wells is less efficient than continuous treatments because more chemicals are typically injected in batch treatment operations.

To avoid inefficiencies associated with treater truck maintenance of hydrocarbon producing wells, it is known in the art to use mechanical pumps to inject chemicals into a well. Typically, mechanical pumps are supplied from a storage tank which holds the chemicals. The mechanical pumps and storage tanks are located adjacent the well for several reasons, such as for reducing the length of power cable or piping that connects the pump to a power source such as electricity or natural gas. The tanks are located above the pump and the chemical is gravity fed to the intake port of the pump Another device known in the art for providing controllable, continuous chemical treatment for well production equipment is disclosed in U.S. Pat. No. 5,209,300 issued to Ayres. An apparatus and method described in the Ayres '300 patent include a vessel which holds the chemical and a pressurized gas which exerts a pressure on the chemical. A pressure regulator and a valve selectively control the injection of the chemical into the well as the pressurized gas urges the chemical out of the vessel. The pressurized gas drives the chemical through the regulator, valve, and into the well without venting the chemical or pressurized gas into the ambient environment. The apparatus described in the Ayres '300 patent is adapted to inject chemicals into the well in essentially undiluted form. It is also known in the art to use the pressurized chemical treatment tank with an automatically controlled "flush" system that dispenses produced water from the well back into the well when treatment chemical is dispensed from the pressurized tank. See, for example, U.S. Pat. No. 7,721,806 issued to Ayres.

SUMMARY

One aspect of the disclosure is a method for injecting treatment chemical into a well that includes selecting times at which to operate a chemical dispenser to inject a selected amount of treatment chemical into a well. At each selected time whether a wellbore pump is operating is determined. If the pump is operating the selected amount of treatment chemical is dispensed into the well. If the pump is not operating, no chemical is dispensed and a counter is incremented. At each subsequent selected time, the determining whether the well pump is operating is repeated. When a subsequent selected time coincides with a time at which the well pump is determined to be operating, the chemical dispenser is operated to inject a product of the number in the counter plus one and the selected amount of treatment chemical into the well.

Other aspects and advantages will be apparent from the following description and the appended claims.

DETAILED DESCRIPTION

Figure 1:
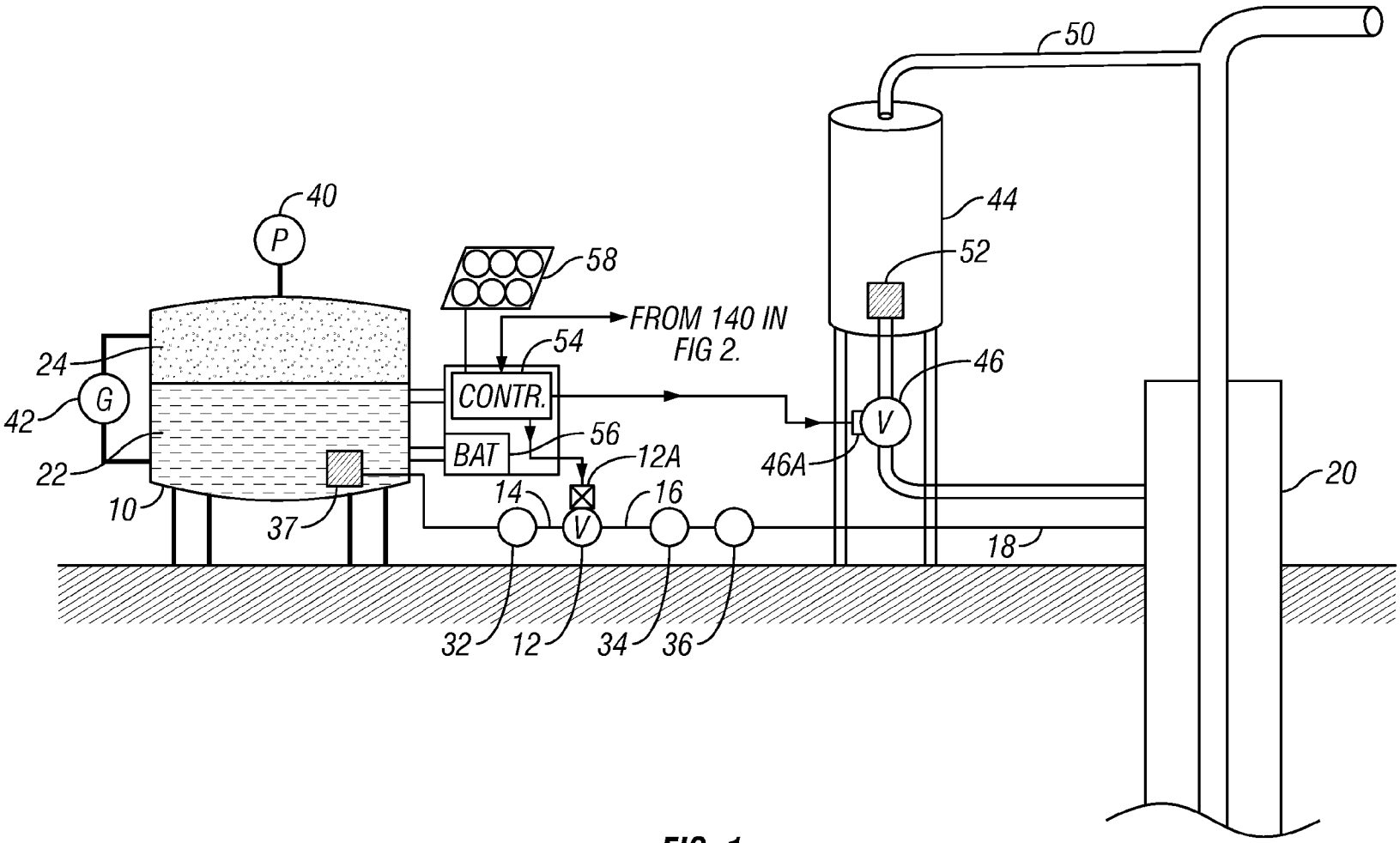
FIG. 1 shows an example automatic treatment system according to one embodiment.

An example embodiment of a chemical treating system that may be used in some embodiments is shown schematically in FIG. 1. A chemical dispenser vessel 10, substantially as described in U.S. Pat. No. 5,209,300 to Ayres. The vessel 10 is distinguishable from containers such as tanks which may only be designed to withstand the hydrostatic pressure exerted by fluid in the tank. Preferably, the vessel 10 is made from glass, carbon or composite fiber reinforced plastic, from stainless steel, or from any other material which is resistant to degradation induced by chemicals and corrosive gases. Alternatively, the vessel 10 can include an inner lining (not shown) resistant to chemical attack. A first control valve 12, which in the present embodiment can be actuated by an actuator 12A, which can be a solenoid or the like, has an inlet end 14 in fluid communication with the interior of the vessel 10. An outlet end 16 of the valve 12 is connected to one end of a fluid injection line 18. The other end of the fluid injection line 18 is coupled to a hydrocarbon producing well 20. Alternatively, the actuator 12A can be a motor/gear set.

Although the well 20 is typically a hydrocarbon producing well, the present example embodiment is useful in other wells relating to the production of hydrocarbons such as injection wells used in enhanced recovery operations. As used throughout this disclosure, the terms "well" and "hydrocarbon producing well" can include all wells directly or incidentally associated with the production from or injection of fluids into subsurface Earth formations.

A treating chemical 22 is typically contained in the vessel 10 in liquid form. It is within the scope of the disclosure that the chemical 22 can comprise any liquid compound or material that can be injected into a well. As representative examples, without limiting the scope of the disclosure, the chemical 22 can comprise chemicals generally identified as corrosion/scale inhibitors, water clarifiers, demulsifiers, and other chemicals which inhibit the formation of chemical, organic, or metallic compounds in hydrocarbon producing wells.

As shown in FIG. 1, a pressurized gas 24 is also disposed in the vessel 10. The pressurized gas 24 preferably includes one or more chemically inert gases, which do not chemically react with the chemical 22. The gas 24 may comprise readily available gases such as nitrogen, helium, argon or carbon dioxide. The pressurized gas 24 is initially charged to a pressure which is less than the condensation pressure for such gas. The condensation pressures are commonly known for each gas, and are not exceeded within the vessel 10 to prevent the mixing, in the liquid phase, of the pressurized gas 24 with the chemical 22. In addition, the density of pressurized gas 24 is preferably less than the density of the chemical 22 so that the chemical 22 is concentrated toward the bottom end of vessel 10, and the pressurized gas 24 is concentrated toward the upper end of the vessel 10. As shown in FIG. 1, the pressurized gas 24 is in contact with the chemical 22 and pressurizes the chemical 22 to the same pressure as that of the pressurized gas 24.

As shown in FIG. 1, a pressure regulator 32 can be installed between the outlet of the vessel 10 and an inlet 14 of the control valve 12. The pressure regulator 32 controls the pressure of the chemical 22 which is communicated to the inlet 14 of the valve 12. For example, if the pressure of the pressurized gas 24 and the chemical 22 in the vessel 10 is 500 pounds per square inch (psi), the regulator 32 can reduce the pressure of the chemical 22 at the inlet 14 of the valve 12 to a selected pressure that is greater than the well 20 pressure. As a representative example, if the pressure of the well 20 is 90 psi, and the desired pressure differential across the valve 12 is 10 psi, then the regulator 32 can be set to reduce the pressure of the chemical 22 from 500 psi to about 100 psi. The regulator 32 should not reduce the pressure of the chemical 22 below the pressure in well 20 because this would prevent the chemical 22 from entering the well 20. To prevent the accidental or inadvertent backflow of well fluids into fluid line 18, a check valve 36 can be installed in the line 18. The control of the pressure differential across valve 12 can be important because the flow rate through certain types of valves is dependent on the size of the valve orifice and the pressure differential between the valve inlet and outlet ports. As the pressure differential across a valve increases, the flow rate through the valve will typically increase unless the valve is designed to maintain a steady flow rate in response to varying flow pressures. As steady rate valves are more expensive than other valves which do not have a pressure compensation feature, the pressure regulator 32 is an inexpensive solution for controlling the flow rate of chemical through the valve 12. The regulator 32 is also useful because the use of the regulator 32 in conjunction with the valve 12 permits the precise metering of small quantities of the chemical 22.

In some embodiments, such as shown in FIG. 1, a second regulator 34 can be located between the valve 12 and the well 20. The valve 12, the first regulator 32, and the second regulator 34 are each in fluid communication with the interior of the vessel 10 and the well 20. In the present embodiment, any pressure fluctuations in the vessel 10 and in the well 20 are thus isolated from the valve 12. Consequently, the pressure differential acting across the valve 12 can be precisely controlled, thereby permitting effective control over the flow rate of the chemical 22 through the valve 12. The present embodiment permits the flow rate of the chemical 22 to be controlled to a very precise rate even substantially less than one one-thousandth of a gallon per day.

In operation, the valve 12 is initially closed to prevent the release of the chemical 22 from the vessel 10. The valve 12 is then selectively opened and the pressurized gas 24 urges the chemical 22 through the first regulator 32, the valve 12, the second regulator 34 through the line 18, and into the well 20.

Preferably, the opening of the valve 12 is timed to selectively control the flow of chemical 22 into well 20. The valve 12 can be operated at particular open durations to selectively increase or decrease the amount of the chemical 22 injected into the well 20. The precise injection amount of the chemical 22 accomplishes several objectives. Certain wells may require large volumes of chemicals to accomplish the desired function. Other wells may require only relatively small quantities of chemicals to accomplish the desired results. For example, certain wells may require only a fraction of a gallon per day to accomplish the desired result, and the injection of additional chemicals is unnecessary to the operation of the well. If more chemical than required is injected into the well, then the excess chemical is superfluous to the operation of the well and results in additional cost to the operator. The present embodiment may selectively control the flow amount of the chemical 22 and may eliminate unnecessary chemical use.

The apparatus of the present embodiment can be configured to control the flow of chemical 22 by selecting the operating time and frequency of operation of the valve 12 from any chemical amount, ranging from essentially a continuous discharge of the chemical 22 from the vessel 10, to any amount even as small as one one-thousandth of a gallon per day or less.

As previously explained, the check valve 36 may also be installed in the injection line 18 to prevent the backflow of fluids in the well 20 into the valve 12 or the vessel 10. This feature is desirable because a well operator could accidentally pressurize well 20 to a pressure higher than that of the chemical 22 in the vessel 10. Alternatively, this function could be incorporated into the design of the valve 12.

In some embodiments, a float 37 or similar means can be located in the vessel 10 to prevent the pressurized gas 24 from exiting the vessel 10. The float 37 has a density less than that of the chemical 22 and is buoyant therein. As the level of chemical 22 is lowered in the vessel 10 by releasing the chemical 22 through the valve 12, the float 37 will be lowered in the vessel 10. When the float 37 reaches a selected position within the vessel 10, the float 37 seals the outlet of the vessel 10 to prevent the release of the pressurized gas 24 from the vessel 10. This function can be performed other than by using the float 37. For example, a liquid level gauge 42 could be used to indicate the level of the chemical 22 within the vessel 10 so that an operator could visually check the level of the chemical 22. In other embodiments, mechanical, electrical, or electronic equipment could be used to indicate the level of the chemical 22 within the vessel 10 or, alternatively, to seal the outlet when the level of the chemical 22 in the vessel is lowered to a certain position. A pressure gauge 40 can be attached to vessel 10 to measure the pressure of the pressurized gas 24. The gauge 42 can be attached to the vessel 10 for measuring the quantity of the chemical 22 in the vessel 10. The gauge 42 can comprise many different embodiments such as sight glasses, electromagnetic switches, and other devices well-known in the art. In addition, the gauge 42 could comprise a flow meter which measures the quantity of fluid flowing from the vessel 10 When the fluid quantity flowing from the vessel 10 is compared to the quantity of the chemical 22 initially installed in the vessel 10, the quantity of the chemical 22 in the vessel 10 at any point in time can be determined.

In the present embodiment the control valve 12 can be operated electrically, such as by the actuator 12A. The actuator 12A can be operated by a controller 54 of any type known in the art, such as a programmable logic controller, for electronic control of operation of a process operating device. The controller 54 may be supplied with electrical power by a battery 56. The battery 56 may be recharged by a solar cell 58. The foregoing electrical power to operate the controller 54 and the actuator 12A are not intended to ultimately limit the scope of the disclosure, but are preferred for economy and reliability of operation.

The present embodiment may include a fluid storage tank 44. The fluid storage tank 44 receives produced fluid from the well 20 through a flowline 50 coupled to an outlet of the well 20. The fluid storage tank 44 is preferably made so that it can hold internal pressure equal to the pressure at the outlet of the well 20. As fluid is produced from the well 20, some of it will enter the flowline 50 and ultimately fill the tank 44. The fluid storage tank 44 may include at its discharge end a float 52 similar in operation to the float 37 on the vessel 10. The outlet of the fluid tank 44 is in hydraulic communication with the well 20 through a second control valve 46 operated by a motor/gear set 46A. It has been determined through experimentation with various types of valve actuators that using a motor/gear set to actuate the second valve 46 reduces the incidence of improper valve operation due to contamination of the valve from materials present in the fluid produced from the well. A motor/gear set may also be less susceptible to the valve 46 being improperly opened by high pressures extant on the outlet side of the valve 46. The motor/gear set 46A can also be operated by the controller 54. As will be explained below, when the valve 46 is operated, fluid in the tank 44 may flow into the well 20. By having equal pressure on the well 20 and the tank 44, fluid in the tank 44 may simply flow by gravity into the well 20.

In the present embodiment, the controller 54 may be programmed to operate the first control valve 12 to selectively discharge the chemical 22, and the control valve 46 for the fluid stored in the fluid storage tank 44 at selected times and durations. Operating the first control valve 12, as previously explained, causes injection of a selected amount of the chemical 22 into the well 20. At substantially the same time, operation of the second control valve 46 causes the contents of the fluid storage tank 44 to flow by gravity into the well 20. Thus, a chemical treatment is supplied to the well 20 that is already dispersed in fluid (which may include oil and/or water) prior to reaching the bottom of the well 20, in the event the fluid level in the well 20 is too low to properly disperse the chemical 22 by itself. In other implementations, the second control valve 46 may not be operated, allowing only treatment chemical to be dispensed into the well 20.

In some embodiments, the float 52 may include a switch (not shown separately) so that the controller 54 will not operate the valves 12, 46 if the level of water in the water tank 44 falls below a selected level. In some embodiments, the second valve 46 can be operated to discharge essentially the entire contents of the fluid storage tank 44 at each operation. In other embodiments, the second valve 46 can be operated to discharge a selected amount of the contents of the fluid storage tank 44. In other embodiments, the second regulator 34 and the check valve 36 may be omitted. Additionally, the controller 54 can be programmed to operate the first valve 12 and the second vale 46 with respect to any timing reference, such as during periods of time in which a pump (not shown) is operating to lift fluids out of the well 20, or at times during which the pump (not shown) is not operating. Alternatively, the controller 54 can be programmed to operate the valves 12, 46 simultaneously, or at different times from each other.

Figure 2:
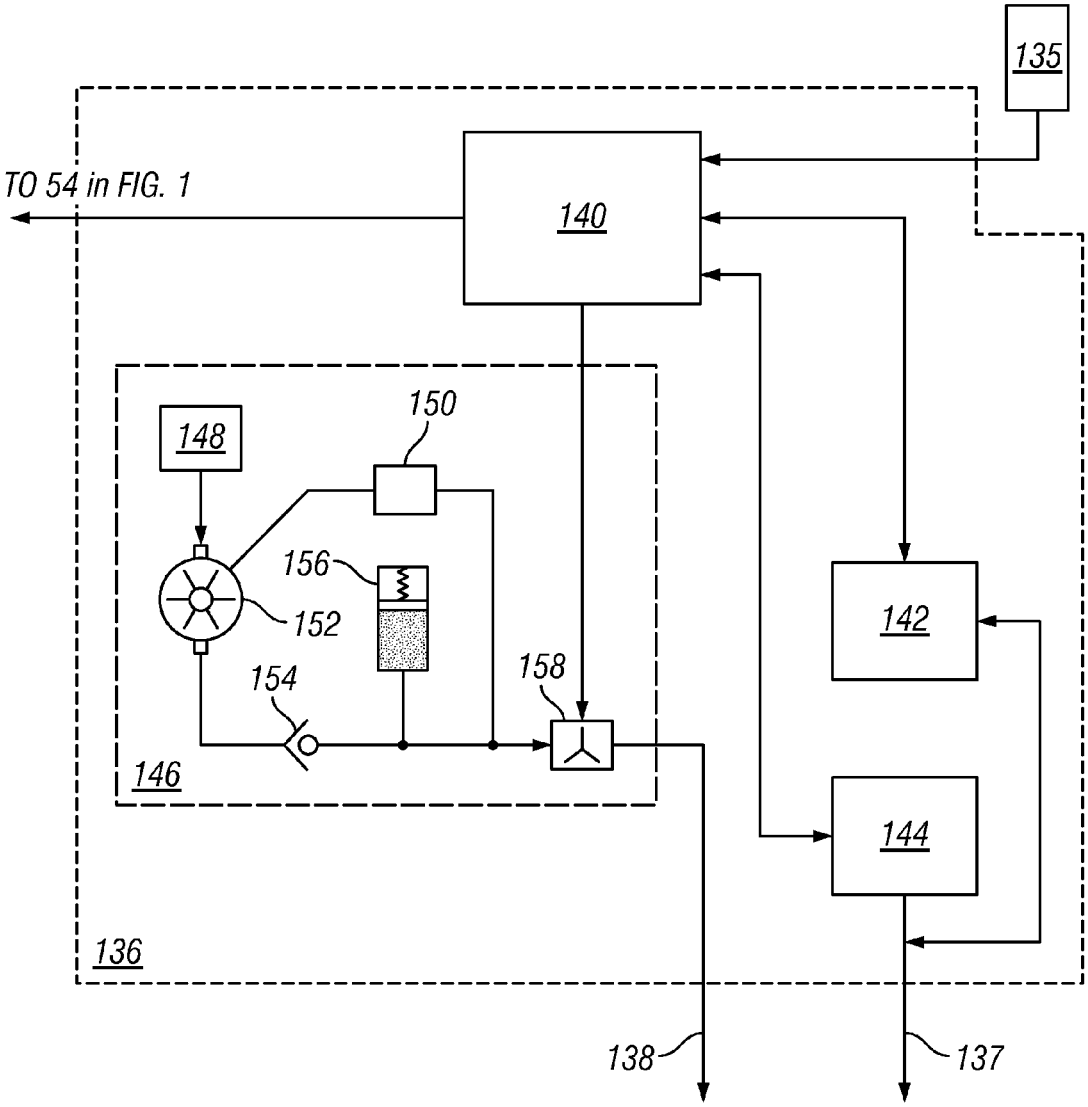
FIG. 2 shows a wellbore pump controller that may be used to communicate a signal to the automatic treatment system of FIG. 1 that corresponds to whether a well pump is operating or is shut off.

FIG. 2 shows a schematic diagram of one example of a control unit 136 for a wellbore pump (not shown), which may be an electric submersible pump (ESP), or any other type of pump. The control unit 136 may include a telemetry transceiver 142 that can receive and decode telemetry from telemetry signals transmitted along a power cable 137 that supplies electrical power to operate the pump. Decoded telemetry, representing measurements from the various sensors (e.g., fluid level or pressure sensors) may be communicated to a central processor ("CPU") 140. The CPU 140 may be any microprocessor based controller or programmable logic controller, such as one sold under the trademark FANUC, which is a trademark of General Electric Corp., Fairfield, CT. A control output of the CPU 140 may be coupled to a motor speed controller 144 of any type known in the art, such as an AC motor speed controller. The AC motor speed controller 144 may be operated by the CPU 140 to cause the motor (not shown) and thus the pump (not shown) and an optional downhole oil/water separator (not shown) to operate at a selected rotational speed. Another control output of the CPU 140 may be coupled to an actuator control 146. The actuator control 146 provides hydraulic pressure to operate a control valve associated with the pump (not shown). Components of a typical actuator control may include a hydraulic pump 152, the inlet of which is coupled to a reservoir 148 of hydraulic fluid. Discharge from the pump passes through a check valve 154 and charges an accumulator 156 configured to maintain a selected system fluid pressure. A pressure switch 150 may stop the pump when the selected system pressure is reached. Hydraulic pressure may be selectively applied to the hydraulic line through a throttling valve 158. The throttling valve may be an electric over hydraulic operated valve coupled to the control output of the CPU 140. Thus, the CPU 140 may be programmed to select both the motor speed and the degree to which the control valve (not shown) is opened. The CPU 140 may be programmed to stop the pump entirely when certain conditions exist in the well (20 in FIG. 1) such as the fluid level in the well being too low, so as to avoid "pump off." The CPU 140 may also send a signal to the controller (54 in FIG. 1) indicative of whether the pump (not shown) is operating or not operating.

While the foregoing example of a pump control unit 136 is used with an ESP, it should be clearly understood that other types of pump control units may be used in other embodiments, and with other types of pumps. For example, the pump may be a standing valve/traveling valve pump operated by "sucker rods" that reciprocate to lift well fluid to the surface. Such sucker rods may be operated by an hydraulic or pneumatic lift unit or a walking beam. The type of pump and control unit is not intended to limit the scope of the disclosure. For purposes of the present disclosure, it is only required that the control unit 136 communicate to the controller (54 in FIG. 1) when the pump is operating or not operating.

Referring back to FIG. 1, the controller 54 may be preprogrammed or otherwise configured to cause operation of the valve 12 to operate at selected times and for selected durations at each time. The controller may be programmed to operate the second control valve 46 at the same or at other selected times and for selected durations. In the present embodiment, when one of the selected times occurs, the controller 54 may interrogate the CPU (140 in FIG. 2) to determine whether the well pump (not shown) is operating or is switched off. If the controller 54 receives indication that the well pump is switched off, the controller 54 may be programmed not to operate either the valve 12, thus not dispensing any chemical, and, optionally, the second control valve 46 so as not to dispense any stored produced water into the well 20. The controller 54 may include an internal register or counter that may be incremented for each time that a selected time occurs and the controller 54 does not operate the valve 12 because of a signal from the CPU (140 in FIG. 2) indicating that the pump is switched off. If in any subsequent selected time at which the controller 54 is scheduled to operate the valve 12 a pump not operating signal is received, the counter in the controller 54 may again be incremented. The foregoing may continue until which time as a selected time to operate the valve 12 coincides with a time a which a signal from the CPU (140) indicates that the well pump is operating. When such selected time with coincident pump operation takes place, the controller 54 may be programmed or configured to operate the valve 12, and optionally the second control valve 46 to open for a duration equal to the product of the preselected duration for an individual chemical treatment and the number of non-operative selected times stored in the register or counter, plus the single treatment duration (thus the product of the treatment duration and the counter value plus one) in the controller 54. The counter may be reset to zero after a predetermined time interval has elapsed.

In some embodiments, the controller 54 may be further programmed to reset the counter to zero or any other selected number after a predetermined time interval has elapsed in which no pump operating signal is present at the controller 54. While not limiting the scope of the present disclosure, such predetermined time interval may be one or two days. By resetting the counter after a predetermined time interval with no pump operating signal, it may be possible to avoid injecting excessive and unnecessary amounts of treatment chemical into the well 20. Non-limiting examples of situations in which a predetermined time interval may be exceeded with no pump operating signal is when the well is undergoing repairs or workover operations, or when the well pump or components thereof are being serviced or replaced.

Embodiments according to the present disclosure may provide properly dispersed treatment chemical for a well even in the event the well is "pumped off" (meaning that the fluid level is insufficient for a downhole pump to lift fluid to the Earth's surface).

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method for injecting treatment chemical into a well, comprising:

selecting times at which to operate a chemical dispenser to inject a selected amount of treatment chemical into a well within a predetermined time interval;

at each selected time, detecting a signal generated by a pump controller corresponding to whether a wellbore fluid lift pump is operating, the wellbore fluid lift pump arranged to lift fluid from the wellbore;

detecting at least one selected time within the predetermined time interval that the wellbore fluid lift pump is not operating, inhibiting operation of the chemical dispenser and incrementing a counter in a controller in signal communication with the chemical dispenser; and operating the chemical dispenser during the predetermined time interval at a subsequent selected time coincident with operation of the wellbore fluid lift pump; and dispensing into the well an amount of treatment chemical equal to the product of the number in the counter plus one multiplied by the selected amount of treatment chemical.

2. The method of claim 1 further comprising dispensing a corresponding amount of produced fluid into the well when treatment chemical is dispensed into the well, wherein the dispending the produced fluid comprises:

storing fluid produced from the well, the storing performed at a pressure extant on the well; and at selected times making an hydraulic connection between the stored, produced fluid and the well so that the produced fluid flows into the well by gravity.

3. The method of claim 2 further comprising determining an amount of stored produced fluid from the well and stopping dispensing the stored fluid into the well when the amount of stored fluid falls below a selected threshold.

4. The method of claim 1 wherein the selected times of have a duration and frequency selected to inject a predetermined quantity of the chemical into the well during the predetermined time interval.

5. The method of claim 1 wherein the dispensing the treatment chemical, comprising:

applying compressed gas to the chemical to pressurize the treatment chemical;

at the subsequent selected time when the pump is operating, making a hydraulic connection between the pressurized chemical and an interior of the well, thereby enabling the pressurized chemical to flow into the well.

6. The method of claim 1 further comprising resetting the counter to zero after the predetermined time interval has elapsed.

* * * * *